United States Patent [19]

Hanula

[11] Patent Number: 4,635,804

[45] Date of Patent: Jan. 13, 1987

[54] YOKE FOR RAILWAY CAR COUPLER ASSEMBLY

[76] Inventor: Richard M. Hanula, 5012 N. Barton Rd., Lyndhurst, Ohio 44124

[21] Appl. No.: 720,690

[22] Filed: Apr. 8, 1985

[51] Int. Cl.[4] ..... B61G 9/04

[52] U.S. Cl. ..... 213/67 R; 213/62 A

[58] Field of Search ..... 213/58, 62 R, 62 A, 213/67 R, 67 A, 69

[56] References Cited

U.S. PATENT DOCUMENTS

| | | | |
|---|---|---|---|
| 2,645,362 | 7/1953 | Spence | 213/62 R |
| 2,990,963 | 7/1961 | Kulieke | 213/62 A |
| 4,428,489 | 1/1984 | Hanula | 213/62 A |

FOREIGN PATENT DOCUMENTS 763817 12/1956 United Kingdom .

*Primary Examiner*—Randolph A. Reese

[57] ABSTRACT

A yoke for a railway car coupler assembly includes a yoke body having a generally rectangular front portion. A central opening provided in the front portion extends longitudinally therethrough. A pair of opposed first and second straps extend rearwardly from the front portion and are connected by a bridge portion. The side walls of the front portion are tapered inwardly toward the bridge portion to accommodate a striker having thickened side walls. Also, recessed portions are provided in the yoke central opening to accommodate the shank of a strengthened coupler. A bearing pad provided on the yoke bridge portion has relieved areas to prolong the service life of the yoke.

8 Claims, 5 Drawing Figures

YOKE FOR RAILWAY CAR COUPLER ASSEMBLY

BACKGROUND OF THE INVENTION

This invention relates generally to a coupler assembly for railway cars and the like. More specifically, the present invention relates to an improved yoke for such a coupler assembly. Although the invention will be described with particular reference to a yoke for rotary coupler assemblies in railway cars, it will be recognized that certain features thereof may also be used or adapted to use in other applications.

After the introduction of the rotary coupler assembly, a train comprised of loaded railroad cars of the open top or hopper-type (which may contain coal, ore, etc.) could be emptied without having to uncouple and separate the cars. This was accomplished by rotating each car up to 180° about its longitudinal centerline while it remained connected on both ends to adjacent cars. Such capability speeded up the gravity empyting process. Rotary coupler assemblies typically include a yoke assembly and a coupler unit, along with a follower, a draft gear, and a striker.

Yokes of the known-type include a generally rectangular front portion having a central opening and a pair of opposed straps extending rearwardly from the front portion with a bridge portion connecting the free end portions of the straps. The tremendous growth in the size of railroad cars in the past decade has, however, placed severe strains on the conventional yokes used in the coupler assemblies presently available.

In addition, disrepair of railroad beds has caused misalignment of trackways which produces undesirable movement between adjacent railroad cars. Such movement, in turn, creates heretofore unknown fatigue failures in the components of conventional car coupling assemblies. One of the components which fails is the yoke. Thus, it has been considered desirable to provide a yoke which is stronger and more durable even under the most severe service conditions.

In order to enhance the strength of one type of coupler assembly, the components thereof have been redesigned. Such redesign is disclosed in the commonly assigned U.S. patent applications to Richard M. Hanula, Ser. No. 322,217, now U.S. Pat. No. 4,428,489, entitled ROTARY RAILROAD CAR F COUPLER, and Ser. No. 518,822, now abandoned, entitled STRIKER FOR RAILWAY CARS, the teachings of which are incorporated hereinto by reference.

Among the redesigned coupler assembly components disclosed in the above two patent applications are a connector and a striker. However, the improvements made to these components have also necessitated a new design for a yoke. One reason this has become necessary is so that the improved yoke can accommodate reinforced rear side wall portions provided on the improved striker, and so that the improved yoke can better guide the connector.

Another coupler assembly component which has been improved is the coupler itself. Such an improved coupler is disclosed in the commonly assigned U.S. patent application Ser. No. 720,798, filed on Apr. 8, 1985, to Richard M. Hanula, entitled IMPROVED COUPLER FOR RAILCAR COUPLER ASSEMBLY, the teachings of which are also incorporated hereinto by reference. The improved coupler therein mentioned has been reinforced to better withstand stresses. While providing for such reinforcement, the yoke has also required redesign to accommodate the reinforced coupler therein.

Moreover, during the coupler improvement process, it was found that the service life of the yoke was frequently reduced by premature failure at the corners of the yoke butt end due to the impact of the draft gear striking in undesirable areas. The present invention contemplates a new and improved rail car yoke which overcomes the foregoing difficulties and others, and which provides better and more advantageous overall results.

BRIEF SUMMARY OF THE INVENTION

In accordance with the present invention, a new and improved rotary coupler assembly having an improved yoke is provided which can better withstand the increased stresses of modern use.

More particularly in accordance with the invention, the yoke has a yoke body including a generally rectangular front portion having a central opening extending longitudinally therethrough. The side walls of the front portion have a certain minimum thickness for strength, and are also tapered inwardly to accommodate a striker having thickened side walls. Opposed first and second straps extend rearwardly from the yoke front portion, and a bridge portion connects the rear or terminal ends of the straps.

In accordance with another aspect of the invention, the front portion central opening is provided with a pair of opposed top and bottom recessed portions to accommodate angling and pivoting of an enlarged coupler. Preferably, the recessed portions are tapered away from each other.

According to another aspect of the invention, the yoke is provided with a load bearing pad on the bridge portion. The pad has a substantially flat central area and relieved sides.

According to a further aspect of the invention, the minimum thickness of the yoke side walls is approximately three-eights of an inch.

The principal advantage of the invention is the provision of an improved rotary coupling system.

Another advantage resides in the provision of an improved yoke which is suitably configured to accommodate a strengthened striker.

Yet another advantage is the provision of a yoke load bearing pad having relieved sides to extend service life.

Still another advantage of the invention is found in the provision of an improved yoke which is suitably configured to accommodate the angling and pivoting movement of a strengthened coupler shank.

Further advantages of the invention will become apparent to those skilled in the art upon a reading and understanding of the following detailed description.

BRIEF DESCRIPTION OF THE DRAWINGS

The invention may take form in certain parts and arrangements of parts, preferred embodiments of which will be described in detail in this specification and wherein.

DETAILED DESCRIPTION OF THE PREFERRED EMBODIMENTS

Figure 1:
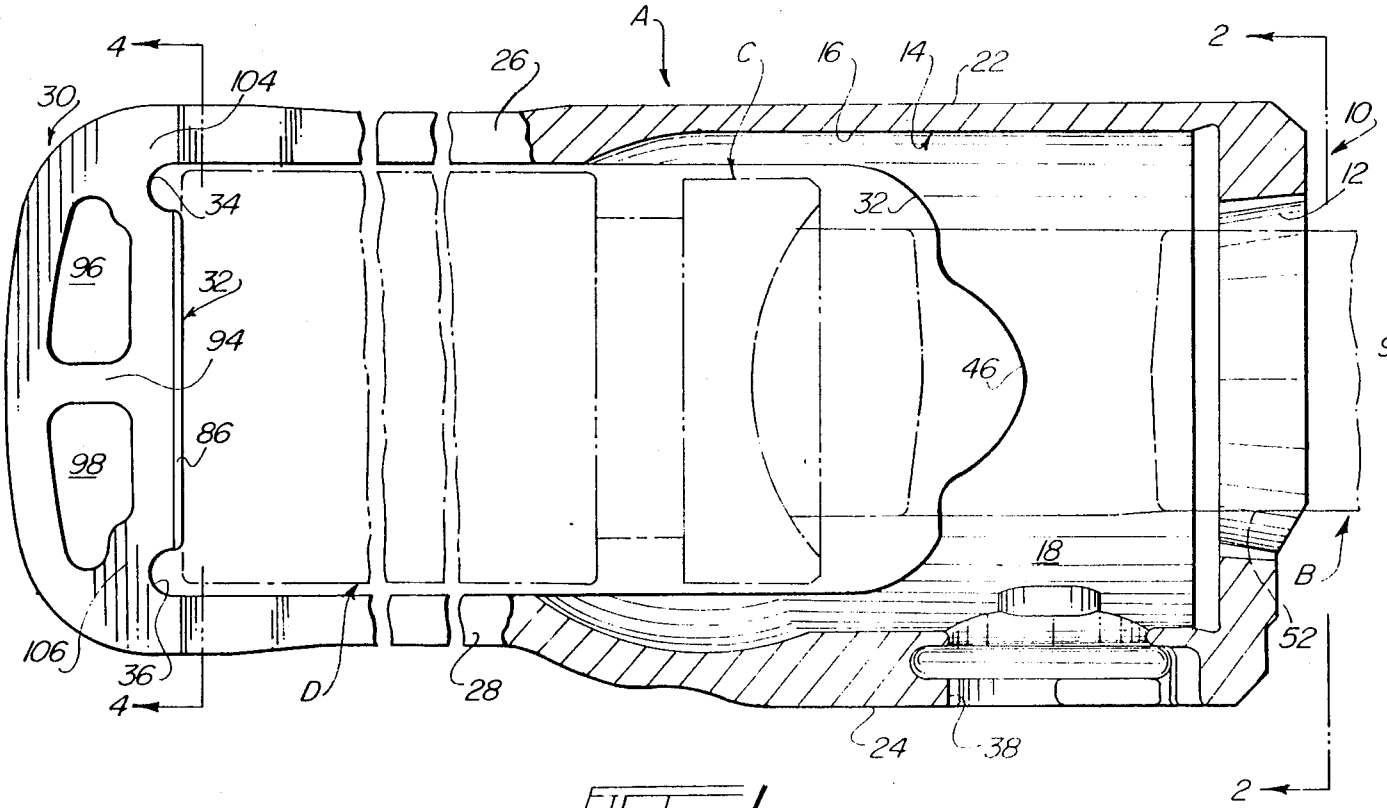
FIG. 1 is a side elevational view in partial cross-section of a yoke formed in accordance with the invention, and including several other coupler assembly components in schematic outline.

With reference now to the drawings, wherein the showings are for purposes of illustrating preferred embodiments of the invention only and not for purposes of limiting same, FIG. 1 shows a yoke A formed in accordance with the present invention. Although yoke A will be illustrated in association with a rotary F-type coupler assembly, it should be appreciated that the yoke load bearing pad could also be adapted for use in a non-rotary F-type coupler assembly or a rigid shank E-type coupler assembly. Moreover, certain of the features of the improved yoke could also be adapted for use for all kinds of AAR (Association of American Railroads) shank connections as long as they utilize a yoke which houses a draft gear.

Figure 2:
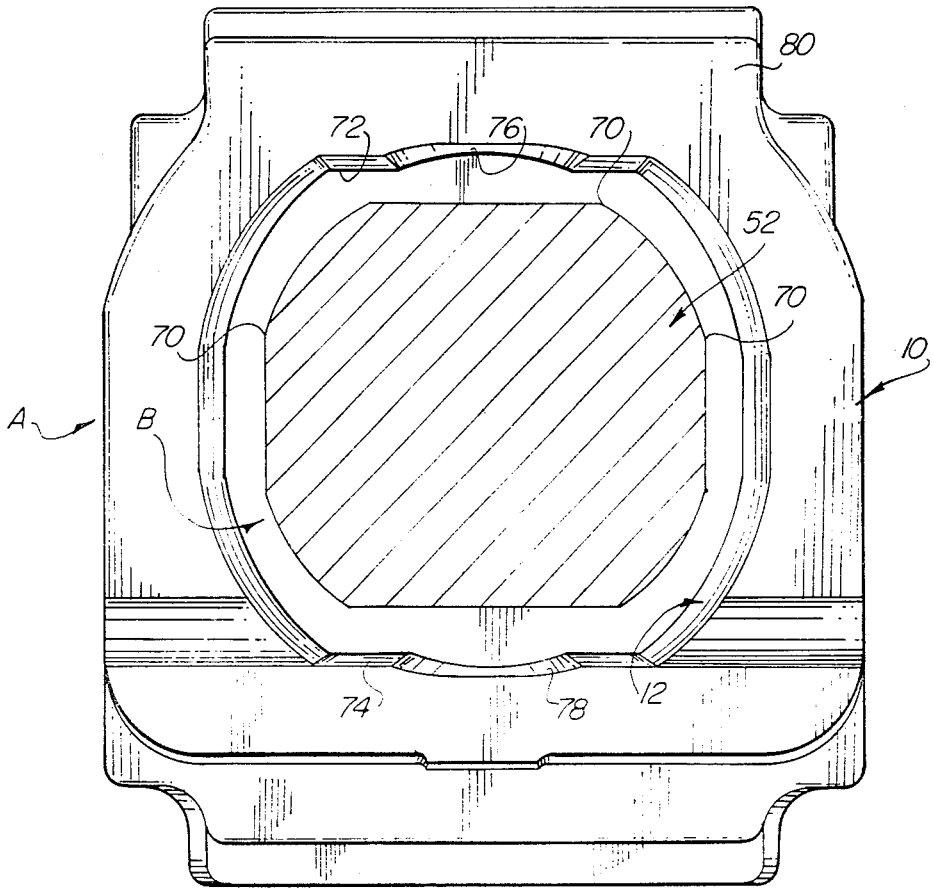
FIG. 2 is a front elevational view of the yoke in the direction of lines 2—2 of FIG. 1 with an associated coupler shank shown in cross-section.

As best shown in FIGS. 1 and 2, yoke A includes a front end area 10 having a centrally disposed generally cylindrical opening 12 which communicates with a larger diameter aperture 14 extending inwardly into and longitudinally of the yoke. A curved inner peripheral wall 16 defines the aperture 14. The front end 10 is generally rectangular in shape and includes a pair of side walls 18, 20 (FIG. 3) as well as a top wall 22 and a bottom wall 24.

A pair of opposed first and second straps 26, 28 extend rearwardly from the front portion 10 at top and bottom walls 22, 24. Generally, the first strap 26 is referred to as the top strap and the second strap 28 is referred to as the bottom strap when the yoke is normally positioned in a rotary coupling assembly. "Normal position" refers to the position wherein the yoke is not rotated about its longitudinal axis, as would be the case during rail car dumping.

A bridge portion 30 connects the rear or terminal ends of the first and second straps 26, 28. The bridge portion is provided with a raised load bearing face 32 defined by a pair of top and bottom bearing-face relieved portions 34, 36. The yoke is also provided with a pivot pin entry opening or aperture 38 which communicates with the yoke inner aperture 14.

Positioned partially within the aperture 14 of the yoke is a coupler B. A free end of the shank of the coupler B contacts a follower C which is also positioned in the yoke. The follower C is urged away from the yoke bridge portion 30 and toward the coupler B by draft gear D housed by the yoke. It should be noted that several rotary coupler assembly components have been deleted from FIG. 1 for the sake of clarity.

Figure 3:
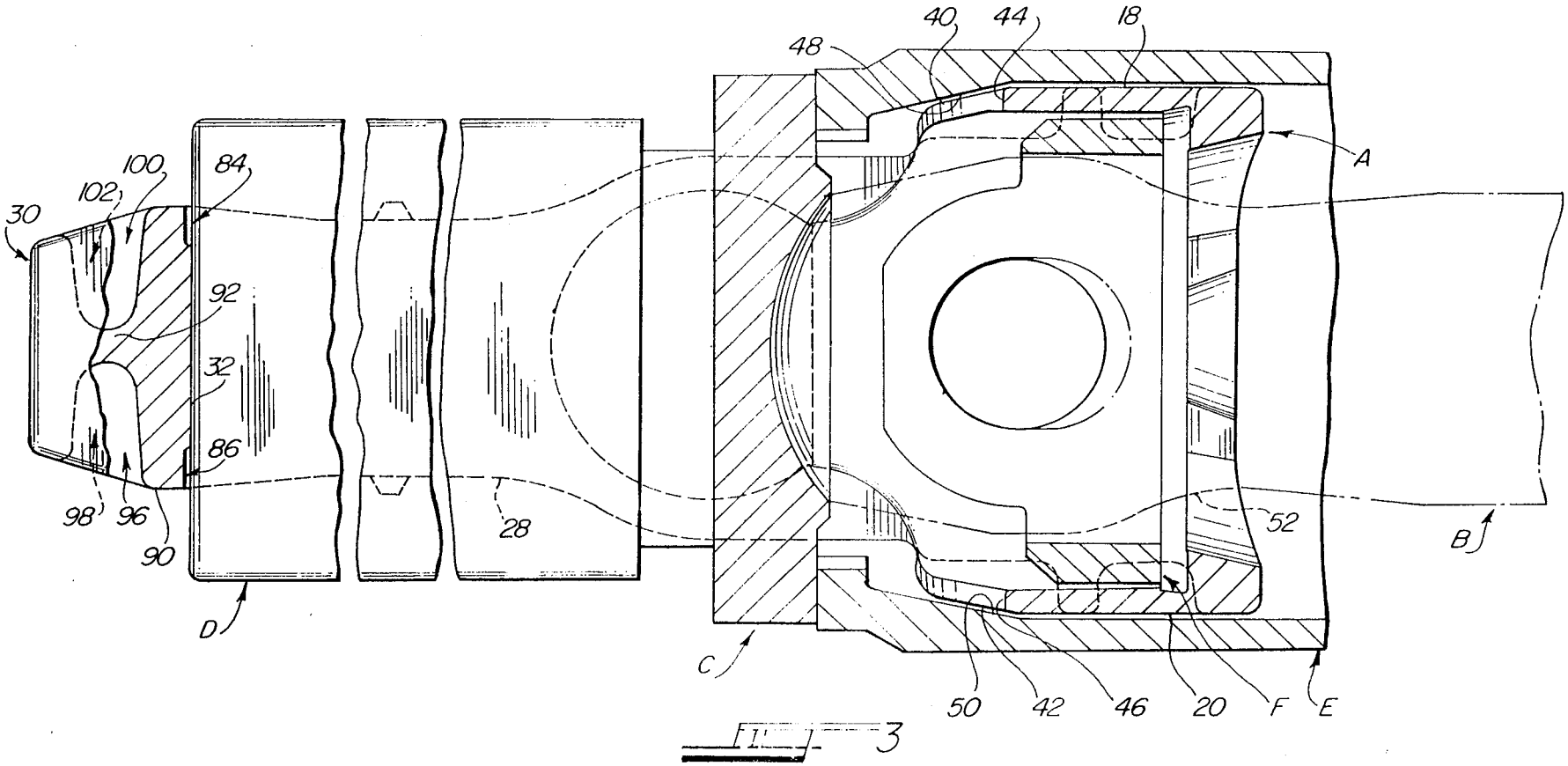
FIG. 3 is a plan view in partial cross-section showing the yoke located in a rotary car coupling assembly.

With reference to FIG. 3, yoke A is also provided with a pair of tapered portions 40, 42 in side walls 18, 20, respectively. Each tapered portion includes a cut out portion 44, 46 (FIG. 3). The tapered portions 40, 42 accommodate thickened rear side wall portions 48, 50 of a striker E which houses the front end of the yoke A. In other words, the tapered side wall portions 40, 42 have been provided on the yoke A to compensate for the thickening of striker rear side wall portions 48, 50.

For maximum guidance of a connector F housed in the yoke A, particularly in the buff position (when the two adjacent railway cars are pushed toward each other), the yoke front end side walls 18, 20 have also been extended rearwardly by the maximum possible amount while maintaining a minimum yoke side wall thickness of approximately three-eighths of an inch (⅜"). This thickness was chosen because it is believed to be a realistic minimum thickness for a large size metal casting, such as the yoke. This minimum yoke side wall thickness requirement has, however, dictated that the cut out portions 44, 46 be provided where the yoke side walls 18, 20 would not be thick enough for casting purposes.

Referring now to FIG. 2, the yoke front aperture 12 is not completely circular. This enables it to accommodate a substantially octagonal shank portion 52 of the coupler B. The coupler shank is octagonally configured for strength to better endure the stresses it undergoes during normal use. Such octagonal configuration allows the coupler shank to bear loads more commensurate with the larger square shanks used in non-rotary coupler assemblies rather than the smaller circular shanks heretofore used in rotary coupler assemblies.

During the process of unloading a unit train by rotary dumping, each of the cars will be rotated approximately 180°; hence, the coupler shank 52 will also go through the 180° rotation. In order to accommodate the larger coupler shank during rotation so that the edges or corners 70 between the adjacent coupler shank faces do not contact the top and bottom surfaces 72, 74 of the yoke front end aperture 12 with detrimental results, a pair of yoke front-face relieved portions 76, 78 are provided on a front face 80 of the yoke adjacent the front aperture 12. With the two yoke front-face relieved portions 76, 78, the coupler shank 52 is able to rotate approximately 180° without contacting or rubbing against the yoke front end top and bottom surfaces 72, 74. The two yoke front-face relieved portions are, preferably, tapered away from each other in a direction outwardly from the front face 80.

Figure 4:
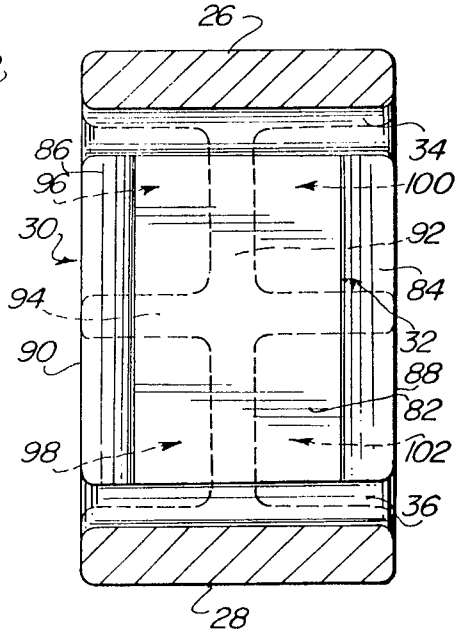
FIG. 4 is a cross-sectional view taken along lines 4—4 of FIG. 1 showing the yoke butt end portion; and, FIG. 5 is a view similar to FIG. 4 for showing an alternate embodiment for the yoke butt end portion.

With reference to FIG. 4, the load bearing pad 32 positioned on the yoke bridge portion 30 includes a central, substantially rectangular support surface 82 with bearing-face side recessed areas 84, 86, disposed on each side thereof. The redesign of the load bearing area 32 was effected in order to prevent premature failure of the yoke. This arrangement relieves the pressure from unsupported sides 88, 90 of the yoke butt end or bridge portion 30 while providing a central load bearing surace 82. A first central support rib 92 (FIG. 3) helps support loads on the support surface 82, and a second central support rib 94 (FIG. 1) also helps support loads on the support surface 82. The two support ribs 92, 94 are normal to each other and comprise a cruciform support surface defined by four apertures 96, 98, 100, and 102. These apertures are commonly referred to as lightener holes.

The subject new design has substantially decreased the possibility of crack formations in yoke A, either in the straps 26, 28 adjacent the top and bottom bearing-face recesses 34, 36 or at fillet areas 104, 106 adjacent to the sides 88, 90 of the load bearing pad 32. Although there are many ways to accomplish the desired effect, the design disclosed herein includes relieved side areas 84, 86 providing approximately a one-sixteenth inch (1/16") relief along the sides of the support surface 82. The relief could also be larger or smaller along the sides of the support surface 82, e.g. ⅛"–1/32". Moreover, the relief could be tapered or straight as may be desired for a particular application. The central support surface 82 is maintained in a flat or slightly concave condition to give good draft gear load support.

It is to be noted that the provision of relieved sides on the load bearing pad 32 of a yoke is applicable to all types of yoke designs, whether the yokes are of the rotary or the non-rotary type. The yoke bearing area embodiment of FIG. 4 is particularly applicable to all vertical pin coupler connections such as the rotary of FIGS. 1, 2, and 3, and AAR Standard F coupler shanks. In these types of assemblies lateral eccentricity on yoke bridge 30 is minimal and only sides of the load bearing pad 32 need to be relieved.

Figure 5:
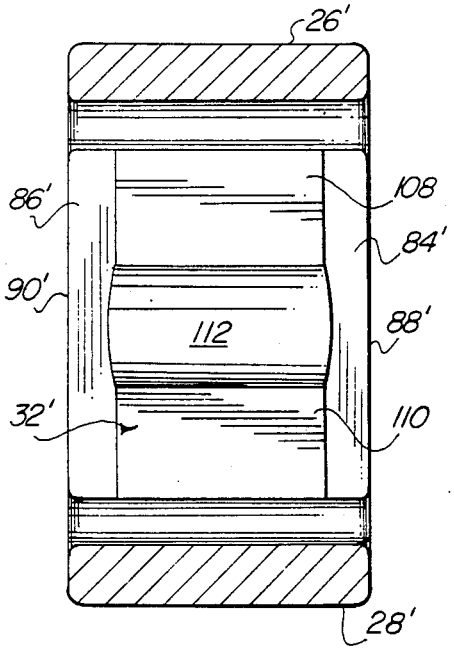

In most rigid shank coupler type assemblies using a cross key, such as the rotary F coupler in U.S. Pat. No. 4,420,088 and AAR Standard rigid shank E couplers, additional relief to load bearing pad 32 has been found to be more advantageous. To that end, FIG. 5 shows the subject invention as it is applied to the load bearing pad of a rigid shank type coupler. For ease of illustration and appreciation of this alternative, like components are identified by like numerals with a primed (') suffix, and new components are identified by new numerals.

In FIG. 5, two load bearing support surfaces 108, 110 are provided. A relieved central portion 112 extends horizontally from one vertically extending recessed area 84' disposed along one side edge to another, similar recessed area 86' disposed along the other side edge to separate the two load bearing support surfaces 108, 110 from each other. Rigid shank type couplers with cross key are prone to lateral coupler angling which produces laterally eccentric loads. For such loads, a central horizontal relief zone 112 in the load bearing pad 32' has been found to be advantageous.

It should also be noted that other configurations of load bearing support surfaces may be advantageously used for other types of coupler assemblies.

Among the advantages afforded by the present invention is the provision of a pair of tapered side walls in a yoke which enable the yoke to cooperate with a strengthened striker while still providing maximum guidance to an enhanced connector. The subject new yoke also provides adequate clearance for a strengthened rotating coupler shank of octagonal form. Moreover, relieved portions are provided on a load bearing surface of the yoke butt to prolong the yoke service life.

Although the invention has been shown and described with reference to preferred embodiments, it is obvious that modifications and alterations will occur to others upon a reading and understanding of this specification. It is intended to include all such modifications and alterations insofar as they come within the scope of the appended claims or the equivalents thereof.

Having thus described the invention, it is now claimed:

1. A yoke for a railway car coupling system, said yoke comprising:

a yoke body including a generally rectangular front portion having a central opening extending longitudinally therethrough with a pair of opposed laterally spaced apart straps extending rearwardly from said front portion and terminating in a bridge portion which connects said straps, said bridge portion including a load bearing pad having a substantially flat load bearing area and relieved portions for prolonging the yoke service life;

said bridge portion including a pair of reinforcing ribs for said load bearing area disposed in a normal relationship to each other, said relieved portions being disposed at upper and lower edges of said load bearing area for preventing the formation of cracks; and wherein the railway car coupling system comprises a vertical pin-type coupler, and said pad comprises recessed areas along opposed side edges thereof.

2. The yoke of claim 1 further including a draft gear positioned between said pair of spaced-apart straps, said draft gear contacting said bearing pad at least when the yoke is in a pull position.

3. A yoke for a railway car coupling system, said yoke comprising:

a yoke body including a generally rectangular front portion having a central opening extending longitudinally therethrough with a pair of opposed laterally spaced apart straps extending rearwardly from said front portion and terminating in a bridge portion which connects said straps, said bridge portion including a load bearing pad having a substantially flat load bearing area and relieved portions for prolonging the yoke service life;

said bridge portion including a pair of reinforcing ribs for said load bearing area disposed in a normal relationship to each other, said relieved portions being disposed at upper and lower edges of said load bearing area for preventing the formation of cracks; and said pad further comprising recessed areas along opposed side edges of said pad, said pad further including a relieved area extending into said load bearing area between said recessed areas intermediate said relieved portions.

4. The yoke according to claim 3, further including a draft gear positioned between said pair of spaced-apart straps, said draft gear contacting said bearing pad at least when the yoke is in a pull position.

5. A yoke of a railway car coupling system, said yoke comprising:

a yoke body including a generally rectangular front portion having a central opening extending longitudinally therethrough with a pair of opposed laterally spaced apart straps extending rearwardly from said front portion and terminating in a bridge portion which connects said straps, said bridge portion including a load bearing pad having a substantially flat load bearing area and relieved portions for prolonging the yoke service life; and said load bearing area comprising a relieved central portion to define two spaced-apart load bearing surfaces, said relieved portions being recessed areas at the side edges of said load bearing area, said relieved central portion extending between said recessed areas.

6. The yoke according to claim 5, further including a draft gear positioned between said pair of spaced-apart straps, said draft gear contacting said bearing pad at least when the yoke is in a pull position.

7. A railway car rotary coupling system comprising:

a striker having thickened side walls adjacent the rear end portion thereof;

a yoke positioned in said striker and having a yoke body including a generally rectangular front portion with a central opening extending longitudinally therethrough and a pair of opposed laterally spaced-apart straps extending rearwardly therefrom, said straps being connected at the outer terminal ends thereof by a bridge portion, said yoke body front portion further having side walls wherein portions thereof taper inwardly toward each other in the direction of said bridge portion to accomodate the thickened side walls of said striker;

a connector positioned in the central opening of said yoke front portion, and being guided by said yoke side walls particularly in the buff position;

said yoke bridge portion comprising a bearing pad and further includes a draft gear positioned adjacent said bearing pad; and said bearing pad having relieved portions for prolonging the service life of the yoke.

8. The coupling system of claim 7 further including a coupler having an octagonal coupler shank positioned in said yoke front portion, said yoke front portion central opening being provided with opposed first and second recessed areas to accommodate angling and pivoting movement of said coupler shank.

* * * * *